US007777634B2

(12) United States Patent
Kaelin et al.

(10) Patent No.: US 7,777,634 B2
(45) Date of Patent: Aug. 17, 2010

(54) SCATTERED LIGHT SMOKE DETECTOR

(75) Inventors: August Kaelin, Bonstetten (CH); Dani Lippuner, Jenins (CH); Giuseppe Marbach, Hombrechtikon (CH)

(73) Assignee: Siemens Aktiengesellschaft, Munich (DE)

( * ) Notice: Subject to any disclaimer, the term of this patent is extended or adjusted under 35 U.S.C. 154(b) by 551 days.

(21) Appl. No.: 11/664,874

(22) PCT Filed: Oct. 6, 2005

(86) PCT No.: PCT/EP2005/055076

§ 371 (c)(1),
(2), (4) Date: Apr. 6, 2007

(87) PCT Pub. No.: WO2006/037804

PCT Pub. Date: Apr. 13, 2006

(65) Prior Publication Data

US 2009/0009347 A1 Jan. 8, 2009

(30) Foreign Application Priority Data

Oct. 6, 2004 (EP) ..... 04023740

(51) Int. Cl.
*G08B 17/107* (2006.01)

(52) U.S. Cl. ..... 340/630; 340/628; 356/342; 356/337; 250/574

(58) Field of Classification Search ..... 340/630, 340/628; 350/574; 356/337, 339, 340, 342; 250/574
See application file for complete search history.

(56) References Cited

U.S. PATENT DOCUMENTS

| | | | | |
|---|---|---|---|---|
| 4,749,871 | A * | 6/1988 | Galvin et al. | 250/573 |
| 5,280,272 | A * | 1/1994 | Nagashima et al. | 340/630 |
| 5,726,633 | A | 3/1998 | Wiemeyer et al. | |
| 6,218,950 | B1 * | 4/2001 | Politze et al. | 340/630 |
| 7,239,387 | B2 * | 7/2007 | Politze et al. | 356/338 |

FOREIGN PATENT DOCUMENTS

| | | | |
|---|---|---|---|
| EP | 1 630 758 | | 3/2006 |
| JP | 11160238 | | 6/1999 |
| JP | 11160238 | A * | 6/1999 |
| SU | 1550555 | | 3/1990 |

* cited by examiner

*Primary Examiner*—Daniel Wu
*Assistant Examiner*—Nay Tun
(74) *Attorney, Agent, or Firm*—Staas & Halsey LLP

(57) ABSTRACT

A scattered light smoke detector containing an optoelectronical assembly for measuring scatter signals detected below at least one forward scatter angle and at least one backscatter angle and evaluation electronics for determining an alarm value in accordance with the difference between the scatter signals. Smoke signals are produced from the scatter signals by means of a pre-processing step and a measured value is obtained from the smoke signals. The measured value is formed by a linear linking of the sum of the smoke signals to the difference between the smoke signals BW, FW or by establishing the value for the difference between the smoke signals. The linear linking is calculated according to the formula $k_1(BW+FW)+k_2(BW-FW)$, in which BW and FW are smoke signals and $k_1$ and $k_2$ represent two constants that are influenced among others by an application factor that is dependent on the environmental conditions in the installation location of the detector.

22 Claims, 2 Drawing Sheets

SCATTERED LIGHT SMOKE DETECTOR

CROSS REFERENCE TO RELATED APPLICATIONS

This application is based on and hereby claims priority to PCT Application No. PCT/EP2005/055076 filed on Jun. 10, 2005 and European Application No. EP04023740 filed on Jun. 10, 2004, the contents of which are hereby incorporated by reference.

BACKGROUND

The present invention relates to a scattered light smoke detector with an optoelectronic arrangement for measurement of scatter signals below a forward and a backscatter angle, and with evaluation electronics for obtaining a measured value from the scatter signals and comparing an alarm value derived from this signal with an alarm threshold.

It has long been known that with forward scatter and backscatter the two scattered light components differ in a characteristic manner for different types of fire. This phenomenon is described for example in WO-A-84/01950 (=U.S. Pat. No. 4,642,471), in which one of the disclosures is that for different types of smoke a different ratio of the scattering at a small scatter angle to the scattering at a large scatter angle can be utilized for detection of the smoke type. The larger scatter angle could also be selected as greater than 90°, meaning evaluation of the forward scatter and backscatter.

For a scattered light smoke detector described in EP-A-1 022 700 (=U.S. Pat. No. 6,218,950) of the type mentioned above a light/dark quotient which can be utilized for detection of the smoke type is calculated from the scatter signals. The two scatter signals are summed and the total is multiplied by the given light/dark quotient. The measured value is thus weighted depending on the ratio of the scatter signals, in which the scatter signal of a dark aerosol is subject to a higher weighting than the scatter signal of a light aerosol.

SUMMARY

One possible object of the invention is to enhance the security against false alarms of the scattered light smoke detector of the type mentioned at the start, while simultaneously guaranteeing a fastest possible response.

The inventors propose that the measured value be formed depending on the difference between the scatter signals or between smoke signals obtained from them.

The advantage of using the difference of the scatter signals or smoke signals to form the measured value instead of using a weighting of the measured value depending on the ratio of the scatter signals is that significantly lower computing outlay is needed and a shorter detector response time is thus guaranteed. The difference between the scatter signals, as well as their quotient, thus enables the smoke type to be detected.

A first preferred embodiment of the scattered light smoke detector is characterized in that the measured value is formed by a linear linking of the sum of the scatter signals or smoke signals to the difference between the scatter signals or smoke signals.

A second preferred embodiment of the scattered light smoke defector is characterized in that the said linear linking is calculated using the formula [k1(BW+FW)+k2(BW−FW)], in which k1 and k2 are two constants which are influenced by factors such as an application factor which depends on the environmental conditions at the intended installation location provided. $0<k_1 . k_2<5$, preferably $0<k_1 . k_2 \leqq 3$, then applies for the given constant.

A third preferred embodiment is characterized in that the measured value is formed from the amount of the difference between the scatter signals or smoke signals.

Preferably the measured value is processed using an application factor which depends on the environmental conditions at the intended installation location. The application factor can be selected for a specific application, and this can preferably be done as a function of a set of setting parameters for the detector dependent on the requirements of the customer.

A fourth preferred embodiment of the scattered light smoke detector is characterized in that the measured value is processed in two paths, that the type of fire involved is determined in the first path and a corresponding control signal is formed and in the second path the said measured value is processed and it is compared with an alarm threshold, and that the processing of the measured value in the second path is controlled by the control signal formed in the first path.

A fifth preferred embodiment of the scattered light smoke detector is characterized in that, in the determination of the type of fire concerned, a distinction is made between smoldering fire and open fire, and if necessary further fire types.

A sixth preferred embodiment is characterized in that the measured value in the second path includes a restriction of the measured value in a subsequent stage referred to as a slope regulator, with the measured value being restricted to a specific level or amplified by addition of a supplementary signal.

A further preferred embodiment of the scattered light smoke detector is characterized in that the slope regulator prevents both a rapid increase in the measured value as a result of signal peaks and also accentuates slow signal increases for smoldering fires. Preferably the slope regulator is controlled by the control signal formed in the first path. In the slope regulator a slow smoke signal is obtained by a very slow filtering of the measured value.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
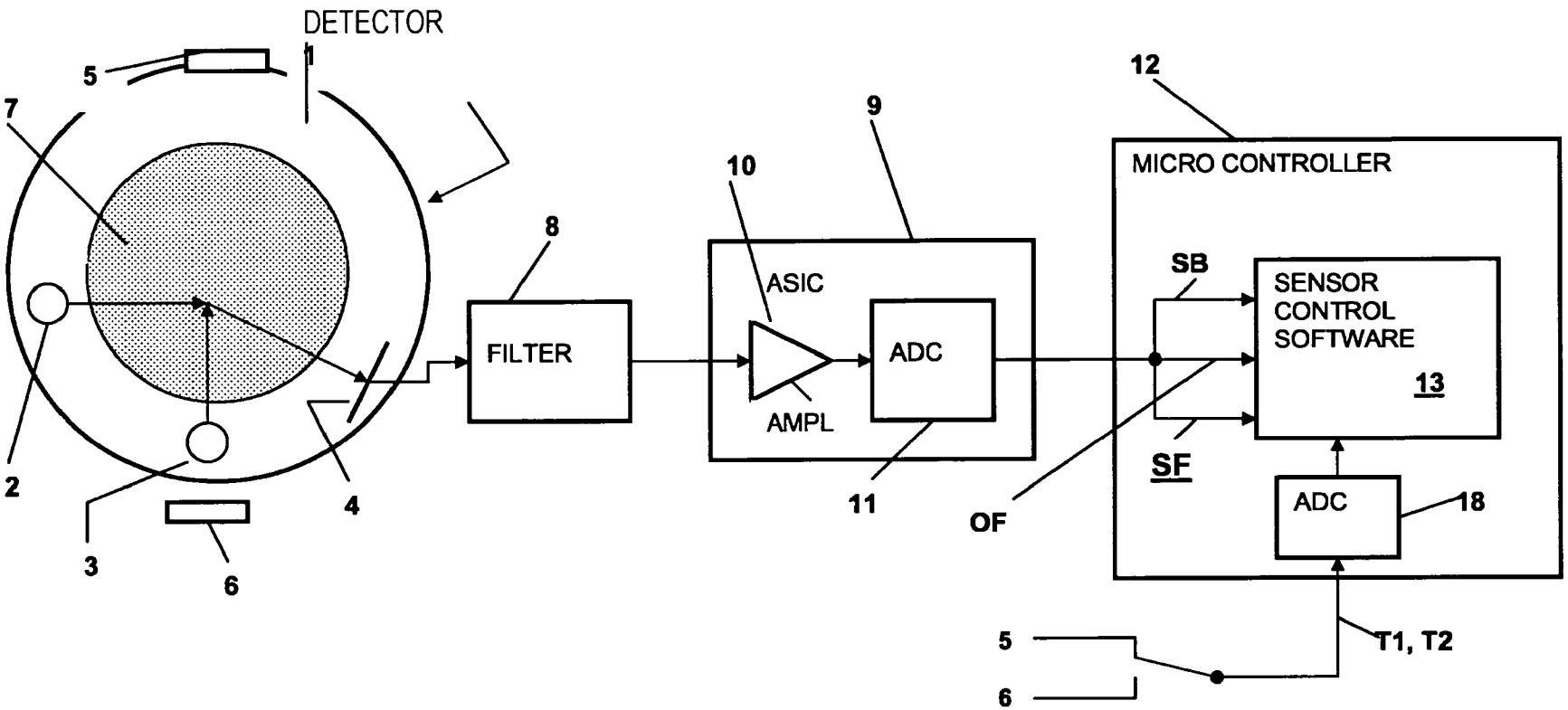
FIG. 1 a schematic block diagram of a smoke detector according to one possible embodiment of the present invention.

Reference will now be made in detail to the preferred embodiments of the present invention, examples of which are illustrated in the accompanying drawings, wherein like reference numerals refer to like elements throughout.

The smoke detector shown in FIG. 1, referred to below as the detector, contains two sensor systems, an electro-optical system with two infrared emitting light sources (IRED) 2 and 3 and a receive diode 4 and a thermal sensor system with two temperature sensors 5 and 6 formed by NTC resistors for measurement of the temperature in the environment of the detector 1. A measurement chamber 7 is formed between the light sources 2, 3 and the receive diode 4. The two sensor systems are arranged in a rotationally-symmetrical housing (not shown), which is attached to a base mounted on the ceiling of a room to be monitored.

The temperature sensors 5 and 6 lie radially opposite one another, which has the advantage that they exhibit different response behavior to air flowing from a particular direction, so that the directionality of the response behavior is reduced. The arrangement of the two light sources 2 and 3 is selected so that the optical axis of the receive diode 4 forms an obtuse angle with the optical axis of the one light source, in accordance with the diagram and forms an acute angle with the optical axis of the other light source. The light of light sources 2 and 3 is scattered by smoke penetrating into the measuring chamber 7 and a part of this scattered light falls on the receive diode 4, in which case, with the scatter being referred to as forward scatter for an obtuse angle between the optical axes of light source and receive diode and as backscatter for an acute angle between the said optical axes. The mechanical design of the detector 1 is not discussed in the present patent application and will thus not be described in greater detail; In this connection the reader is referred to EP-A-1 376 505 and to the literature references cited in this application.

For improved discrimination between different aerosols active or passive polarization filters can be provided in the beam entry on the transmitter and or receiver side. As a further option 2 and 3 diodes can be used as light sources, emitting a radiation in the wavelength range of visible light (see EP-A-0 926 646 in this context) or the light sources can emit radiation of different wavelengths, for example one light source red or infrared light and the other blue light. It is also possible to use ultraviolet light.

The detector 1 takes a measurement every 2 seconds for example, with the forward and backscatter signals being generated sequentially. The signals of the receive diode, which will be referred to below as sensor signals, then enter a filter 8, where they are freed from the coarsest disturbances of a defined frequency range. Next, they are processed in an ASIC 9, which- features an amplifier 10 and an A/D converter 11. Subsequently, the digitized sensor signals SB (backscatter signals) and SF (forward scatter signals) referred to below as scattered light signals, arrive at a microcontroller 12 containing sensor control software 13 for the digital processing of the scatter signals.

An offset signal OF is fed to the sensor control software in addition to the scatter signals SB and SF. This is the output signal of the receive diode 4, if scattered light of one of the two light sources 2 or 3 is not applied to this diode. The signals designated T1 and T2 of the two temperature sensor 5 and 6 are also fed to the microcontroller 12 and, after digitization in an A/D converter 18, arrive at the sensor control software 13.

Figure 2:
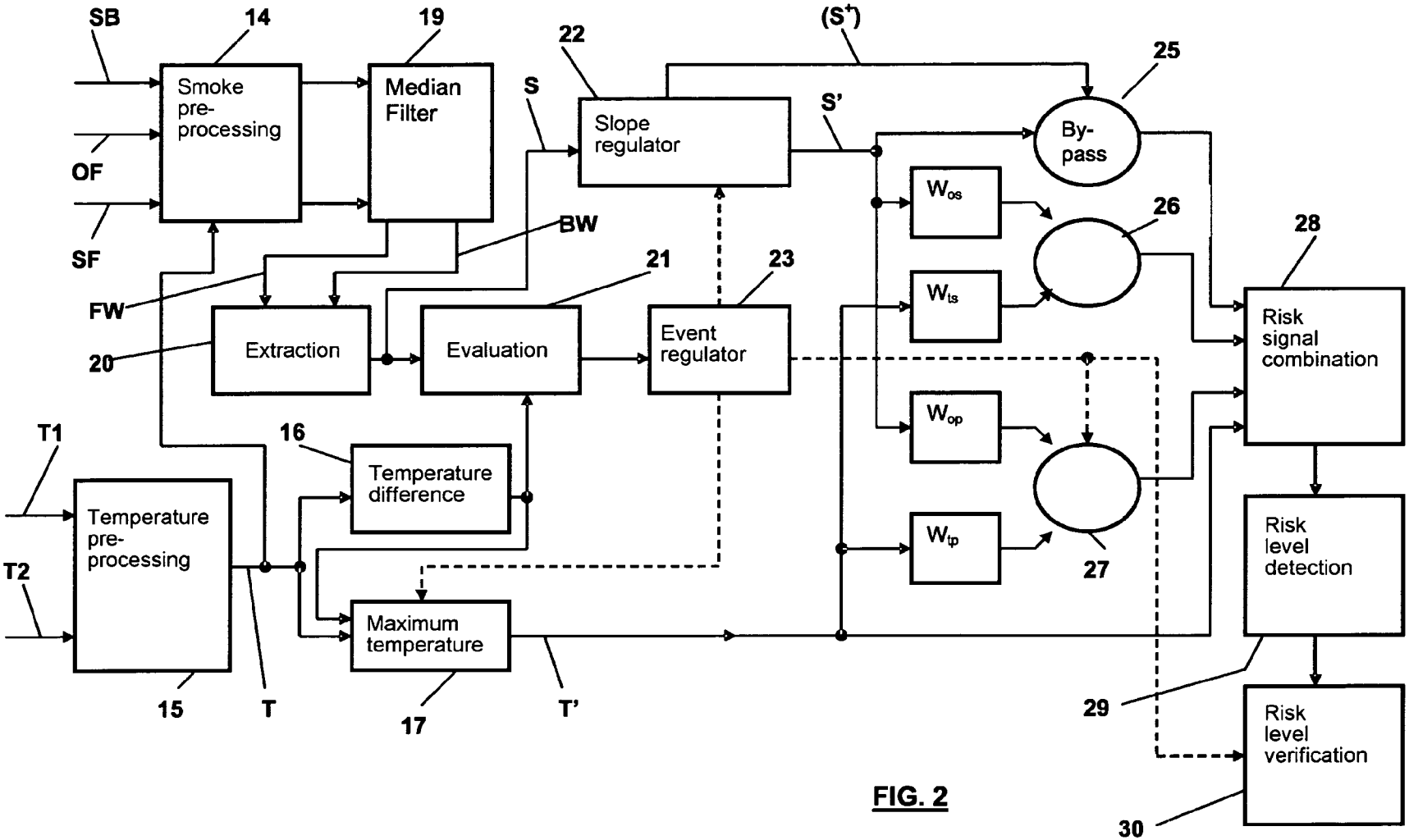
FIG. 2 a schematic block diagram of the signal processing of the smoke detector of FIG. 1.

The processing of the signals of the different sensors with the sensor control software 13 will now be explained with reference to FIG. 2: First of all a separate preprocessing of both the scatter signals SB and SF as well as of the offset signal OF on one side and also of the signals T1, T2 of the temperature sensor 5, 6 on the other side is undertaken in a preprocessing stage 14 or 15 in each case. In the smoke preprocessing 14 the variations of the offset signal OF are smoothed out by restricting the growth or the reduction of the sensor signals to a predetermined value. The offset signal OF is then subtracted from the scatter signals. The preprocessing of signals T1 and T2 in the temperature preprocessing 15 is necessary because there is a difference between the measured and the actual temperature which is a result of factors such as the thermal mass of the NTC resistors 5 and 6 and of the detector housing, the position of the NTC resistors in the detector 1 and the influences of the detector and its environment, which lead to a delay. The measured temperature is compared to a reference value and subsequently calculated back to the actual temperature using a model. This actual temperature is linearized and its rise in restricted so that a temperature signal T is obtainable at the output of the temperature preprocessing facility 15, said signal being fed inter alia to the smoke preprocessing facility 14.

In the smoke preprocessing facility 14, after scatter signals SB, SF have been compensated for with the offset signal, a temperature compensation is undertaken in which a correction factor is obtained from the temperature signal T by which the scatter signals SB, SF will be multiplied. If the detector 1 is a purely optical detector without temperature sensors 5 and 6 a single temperature sensor is provided in the detector which delivers a temperature signal.

The temperature signal T also reaches a temperature difference stage designated by the reference symbol 16 and a maximum temperature stage designated by the reference symbol 17. In the maximum temperature stage 17 an analysis is undertaken as to whether the maximum of the temperature signal T exceeds an alarm value of for example 80° C. (in some countries 60° C.). In the temperature difference stage 16 an investigation is undertaken as to how quickly the temperature signal T is rising. The output of stage 16 is connected to an input of stage 17, at the output of which a temperature value T' is obtainable which is used for further signal processing.

The scatter signals preprocessed in stage 14 reach a median filter 19 which selects the median value from a number, preferably five, consecutive values of the sensor signals. The median filter 19 also contains a so-called time shifter, which selects from the said five sensor signals the middle signal in respect of the sequence, i.e. the third value. Then the difference between these two values is formed which is proportional to the variations of the scatter signals and an estimation of the standard deviation of the scatter signals is made possible. This in its turn allows the computation of disturbances. The output signals of the median filter 19, referred to below as smoke signals BW and FW, arrive at an execution stage designated by the reference symbol 20 for obtaining a smoke value S. The reference symbol BW designates the backward smoke signal and the reference symbol FW the forward smoke signal.

Background compensation is undertaken in the extraction stage 20 by very slow filtering, in which disturbances caused by dust formation are compensated for. In addition the total of the smoke signals (BW+FW) and the difference between the smoke signals (BW−FW) is formed and multiplied by an application factor in each case. The terms formed in this way are then linked in a linear relationship, for example according to the formula $$k1(BW+FW)+k2(BW-FW), \qquad \text{(formula 1)}$$

in which k1 and k2 refer to the said application factors. Alternatively the amount of the difference of the smoke signals |BW−FW| can be formed, this also being processed with an application factor, which in this case is preferably formed by an exponent.

The result of the two processes, either the linear combination or the formation of the difference, is the so-called measured value S obtainable at the output of the extraction stage 20, on which the further signal processing is based. The application factor depends on the intended application and on the intended location at which the detector 1 will be used, or in other words on the type of fire to be detected as a priority, especially whether it is a smoldering fire or an open fire.

Each detector 1 possesses a set of suitable parameters adapted to its installation site and to the wishes of the customer, this being referred to as the parameter set. For detector 1 for example this depends on the critical fire size, the fire risk, the risk to people, the value concentration, the room geometry and the false alarm variables, with the false alarm variables for example being able to be formed by smoke not originating from the fire, exhaust gases, steam, dust, fibers or electromagnetic disturbances. The following then applies for the linear combination of the smoke values according to formula 1 for the two application factors k1 and k2: $0<k1.\ k2<5$, preferably $0<k1.\ k2\leqq 3$. In the formation of the difference |BW−FW| the application factor lies between greater than zero and two. The difference |BW−FW| may if necessary be multiplied by a factor lying within the single-digit range.

In the extraction stage 20 an optimization of the working area of the A/D converter 11 (FIG. 1) and a determination of the short-term and long-term variance of the sensor signals and the variations of the noise in the signal is undertaken. A large variance indicates faults and can trigger a reduction of the detection speed for specific parameter sets. In addition a derived analysis is also undertaken in stage 20 in which it is calculated whether the sensor signal primarily increases over a longer period of for example 40 seconds, meaning that it grows in a monotonous fashion, with a monotonous increase in the sensor signal indicating a fire. The result of the derived analysis is used with a few of the parameter sets to adapt the speed of the signal processing.

If for example the sensor signal increases monotonously and the fire is evaluated in the subsequent evaluation stage 21 as an open fire, the speed of the signal processing can be multiplied to obtain a more sensitive parameter set. The monotony is determined by the fact that specific pairs (Vn) and (Vn−5) are selected from a plurality of for example 20 values of the sensor signal, for example the first (V1) and the sixth (V6), the sixth (V6), and the eleventh (V11) value, and so forth, and the difference (Vn−Vn−5) is formed. A difference Vn−Vn−5>0 corresponds to a monotonous increase of the sensor signal and this is an indication of fire.

The measured value S is fed from the output of the extraction stage 20 on one side to the evaluation stage 21 and on the other side to a stage referred to as a slope regulator 22 for controlling the signal form. In the evaluation stage 21 the fire type, the so-called disturbance criterion, the so-called monotony criterion and the significance of the temperature are determined. The fire type is determined on the basis of the difference (BW−FW) or the linear combination (BW+FW)+(BW−FW), with smoldering fire, open fire or transient fire being considered as possible types of fire. A transient fire is taken as the transition from a smoldering fire to an open fire, which is detected in the ignition of the fire. Naturally the quotient (BW/FW) can also be used for determining the fire type, as described for example in WO-A-84/01950 (=U.S. Pat. No. 4,642,471). One of the disclosures in this publication is that, for different smoke types, it is possible to exploit the different ratio of the scatter at a small scatter angle to the ratio of the scatter at a large scatter angle in the detection of the smoke type, with an angle of greater then 90° also being able to be selected.

For determining the disturbance criterion, the disturbances calculated from the standard deviation (median filter 19) are compared with a threshold value. For determining the monotony criterion the monotony of the sensor signal calculated during the derived analysis in the extraction stage 20 is compared to a threshold value. The importance of the temperature is determined by comparing the rise ΔT of the temperature signals T1, T2 with a threshold value; ΔT>20° means fire.

The output of the evaluation stage 21 is fed to an event regulator 23 which on one side controls the slope regulator 22 and on the other side the maximum temperature 17. In the event regulator 23 the system decides whether and if necessary how the signal processing is to be modified. Such a modification is undertaken in the slope regulator 22, which represents an intelligent limiter of the rise/fall of the sensor signals and also defines symmetry and gradient of the sensor signal.

In a few parameter sets for example one would like to forbid, restrict or support purely optical alarms, that is alarms only caused by smoke. To this end a method is used which limits the measured value S during a rise to a specific value and on the other hand derives a specific maximum value from a delayed smoke signal, and then, depending on whether ignition has occurred, uses the two values for further processing. On the one hand this causes a restriction of very fast rises in the measured value S caused by signal peaks and on the other hand accentuates (supports) signals which rise very slowly caused by smoldering fires.

Two signals are obtainable at the output of the slope regulator 22, on one side a smoke value S' obtained by the processing just described and on the other hand a smoke signal S+ obtained by very slow filtering. The smoke value S' will be used for further processing and is fed to a bypass adder 25 among other units, to which the slow smoke signal S+ is also fed. In a stage arranged directly before the bypass adder 25 (not shown) the smoke value S' is limited to a value depending on the respective parameter set, to which the slow smoke signal S+ is then added in the bypass adder 25, with the rise of the slow smoke signal S+ depending on the relevant parameter set and being smaller for a robust parameter set than it is for a sensitive parameter set. The bypass adder 25 is thus used, for a robust parameter set with a rapidly increasing smoke value S', to avoid an alarm which is too rapid, and for a sensitive parameter set with a slowly increasing smoke value S' to support the triggering of the alarm.

The smoke value S' and the temperature value T' are processed in the form of two values Wos and Wop or Wts and Wtp respectively, with the meanings of the values being as follows:

$W_{os}$ Weight of the optical path for summation $W_{op}$ Weight of the optical path for product formation $W_{ts}$ Weight of the thermal path for summation $W_{tp}$ Weight of the thermal path for product formation.

The fact that both a summation 26 and also a multiplication 27 are undertaken has the advantage that in the summation 26 an alarm is triggered at a high temperature and also only a small smoke value and in the multiplication 27 also at low temperature and small smoke value. The corresponding values are added and multiplied, which together with the signal of the bypass adder 25 and the temperature value T' produces four signals which are fed into a risk signal combination unit 28. This looks for the signal with the highest value from the four fed signals as the alarm signal.

In a risk level detection unit 29 following on from the risk signal combination unit 28 the signal of the risk signal combination unit 28 is assigned to individual risk stages and a check is made in a risk level verification unit 30 as to whether the risk level involved is exceeded over a specific period of for example 20 seconds. If it is, an alarm is triggered. The dashed-line connections from the event regulator 23 to the maximum temperature unit 17, to the slope regulator 22, to the multiplication unit 27 and to the risk level verification unit 30 symbolize control lines.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in Superguide v. DIRECTV, 69 USPQ2d 1865 (Fed. Cir. 2004).

The invention claimed is:

1. A scattered light smoke detector, comprising:

an optoelectronic system to detect a forward scatter signal obtained from a forward scatter angle and to detect a back scatter signal obtained from a backscatter angle; and evaluation electronics for obtaining smoke signals from the scatter signals and a measured value from the scatter signals, wherein the evaluation electronics comprise a median filter for obtaining backward and forward smoke signals from the backscatter and forward scatter signals, with the median filter obtaining the backward and forward smoke signals from a difference between a median value of a sequence of consecutive values of the backscatter and forward scatter signals and a middle value of the sequence of consecutive values of the backscatter and forward scatter signals, the middle value being identified based on a middle signal of the sequence.

2. The scattered light smoke detector as claimed in claim 1, wherein the measured value is formed by a linear linking of a sum of the scatter signals or smoke signals with a difference between the scatter signals or smoke signals.

3. The scattered light smoke detector as claimed in claim 2, wherein the linear linking is undertaken using a formula $k_1(BW+FW)+k_2(BW-FW)$, in which BW and FW are the smoke signals and $k_1$ and $k_2$ are two constants determined by environmental conditions at an intended installation site of the detector.

4. The scattered light smoke detector as claimed in claim 3, wherein $0<k_1$ and $k_2 \leqq 3$.

5. The scattered light smoke detector as claimed in claim 3, wherein $0<k_1$ and $k_2<5$.

6. The scattered light smoke detector as claimed in claim 3, wherein the $k_1$ and $k_2$ are determined by an application factor related to the environmental conditions, and the application factor is selected by a customer for a specific application.

7. The scattered light smoke detector as claimed in claim 6, wherein the application factor is detected depending on setting parameters of the detector corresponding to requirements of the customer.

8. The scattered light smoke detector as claimed in claim 1, wherein the measured value is equal to the difference between the scatter signals or smoke signals.

9. The scattered light smoke detector as claimed in claim 8, wherein the measured value is processed with an application factor which depends on environmental conditions at an intended installation site of the detector.

10. The scattered light smoke detector as claimed in claim 1, wherein the measured value is processed in two paths, in the first path a type of fire involved is determined and a corresponding control signal is formed, in the second path the measured value is processed and is compared with an alarm threshold, and the processing of the measured value in the second path is controlled by the control signal formed in the first path.

11. The scattered light smoke detector as claimed in claim 10, wherein, when the type of fire involved is determined, a distinction is made between at least a smoldering fire and an open fire.

12. The scattered light smoke detector as claimed in claim 11, wherein in the second path, the measured value is processed in a slope regulator, and in the second path, the measured value is restricted to a specific level or amplified by addition of a supplementary signal.

13. The scattered light smoke detector as claimed in claim 12, wherein the slope regulator both prevents a rapid increase in the measured value as a result of signal peaks and also accentuates slow signal increases associated with smoldering fires.

14. The scattered light smoke detector as claimed in claim 13, wherein the slope regulator is controlled by the control signal formed in the first path.

15. The scattered light detector as claimed in claim 14, wherein the slope regulator produces a slow smoke signal by a very slow filtering of the measured value.

16. The scattered light smoke detector as claimed in claim 15, wherein the optoelectronic system and the evaluation electronics are provided in a housing, the scattered light smoke detector further comprises a temperature sensor located in or on the housing, the temperature sensor measuring ambient temperature of the detector and outputting a temperature signal.

17. The scattered light smoke detector as claimed in claim 16, wherein the slope regulator produces both a smoke value and a slow smoke signal, an alarm output is determined based on the smoke value, the slow smoke signal, and the temperature signal.

18. The scattered light smoke detector as claimed in claim 17, wherein both a summation and a product formation are undertaken with the smoke value and the temperature signal.

19. The scattered light smoke detector as claimed in claim 18, wherein the smoke value is processed using values $W_{os}$ and $W_{op}$, the temperature signal is processed using values $W_{ts}$ and $W_{tp}$, and $W_{os}$ designates a weight of an optical path for the summation, $W_{op}$ designates a weight of an optical path for the product formation, $W_{ts}$ designates a weight of a thermal path for the summation and $W_{tp}$ designates a weight of a thermal path for the product formation.

20. The scattered light smoke detector as claimed in claim 19, wherein the summation produces a first value and the product formation produces a second value, the larger of the first and second values is selected and compared with the alarm threshold to produce a comparison result.

21. The scattered light smoke detector as claimed in claim 20, wherein the comparison result is assigned to one of a plurality of different risk levels and subsequently the risk level is verified.

22. The scattered light smoke detector as claimed in claim 21, wherein verification of the risk level is controlled by the control signal formed in the first path.

* * * * *